United States Patent [19]

Painter

[11] 4,226,583

[45] Oct. 7, 1980

[54] PHOTOFLASH LAMP WITH KNURLED FOIL STRIP

[75] Inventor: Howard S. Painter, Linden, Pa.

[73] Assignee: GTE Products Corporation, Stamford, Conn.

[21] Appl. No.: 974,299

[22] Filed: Dec. 29, 1978

[51] Int. Cl.[3] ..... F21K 5/00; F21K 5/02

[52] U.S. Cl. ..... 431/362

[58] Field of Search ..... 431/362, 361, 363

[56] References Cited

U.S. PATENT DOCUMENTS

| | | | |
|---|---|---|---|
| 2,955,447 | 10/1960 | Fink et al. | 431/362 |
| 3,002,367 | 10/1961 | Fink | 431/362 |
| 3,199,316 | 8/1965 | Cressman | 431/362 |
| 3,303,674 | 2/1967 | Anderson | 431/362 |
| 3,384,441 | 5/1968 | Zink et al. | 431/362 |

*Primary Examiner*—Joseph Man-Fu Moy

*Attorney, Agent, or Firm*—Edward J. Coleman

[57] ABSTRACT

A long-duration photoflash lamp comprising a sealed glass bulb containing a gas filling of oxygen and nitrogen, an ignition filament, and a corrugated strip of magnesium foil having a knurled surface for optimizing usable light output.

10 Claims, 6 Drawing Figures

PHOTOFLASH LAMP WITH KNURLED FOIL STRIP

BACKGROUND OF THE INVENTION

This invention relates to photoflash lamps and, more particularly, to photoflash lamps characterized by a duration of light emission at useful light levels many times longer than that of the more popular types of presently available commercial flashlamps.

Generally speaking, the present art of making photoflash lamps is concerned primarily with photographic flashlamps which have a high intensity light peak or a certain level of light intensity for a maximum duration in the millisecond range. Such a light source usually comprises an hermetically sealed envelope, provided with a protective coating, and filled with a combustion-supporting gas and a combustible, usually in the form of shredded foil, which upon ignition, burns with a brilliant, fast flash. The ignition system usually comprises a pair of lead-in wires, a coating of ignition paste on the inner ends of the lead-in wires, and a fine tunsten filament attached to and supported by the lead-in wires near the inner ends thereof. Other currently used ignition systems for photoflash lamps include percussively activated primer tubes and high voltage activated primer bridge structures.

Although this type of photographic flashlamp has proved to be quite satisfactory for the more conventional uses, it has been found that for certain applications, such as motion picture, and especially high-speed motion picture, photography for example, a light source of useful light levels characterized by a duration of light emission in the order of seconds is highly desirable. Such lamps are particularly useful in obscure areas where it is not feasible or practical to run power cables. These uses include spelunking, crashing of cars to observe operation of safety equipment, etc. Another use has been in the space program.

Long-duration lamps have been made since the late '50's. For example, U.S. Pat. No. 2,955,447 Fink et al describes such a lamp containing a magnesium strip and a gas filling consisting of oxygen and between 2% to about 12% of nitrogen by volume. Subsequently, U.S. Pat. No. 3,002,367 Fink issued and described an improved support structure for the foil strip in a long-duration lamp. In this latter Fink patent, the magnesium foil strip was corrugated into a W-shaped configuration and was provided with a plurality of apertures. The foil strip is supported over a filament ignition structure, and the edge portion of the foil strip adjacent to the ignition structure is coated with primer material to facilitate firing of the strip. If this primer coating is disposed on a plane foil surface, a problem has been experienced in that the primer tends to come loose either before or after the sealing-in operation. Accordingly, a row of straight embossments were provided along the edge of the foil where the primer is applied; the resulting added surface area causes the primer mixture to adhere better to the magnesium. This technique of embossing the lower edge of the magnesium strip for improved primer adhesion has been used for several years but is not shown in the above-mentioned Fink patent.

Although the long-duration photoflash lamp described in the Fink U.S. Pat. No. 3,002,367 provides excellent performance for its intended applications, the time-light curve of the lamp is characterized by two or three peaks, and the beginning and trailing portions of the curve are quite rounded. It would be advantageous to have a lamp with a higher light level while still maintaining a long-time duration. Better quality photographs can be obtained if the combustion proceeds more evenly.

A U.S. Pat. No. 3,199,316 of Cressman describes a long-duration lamp which is claimed to emit at least 10,000 lumens for a time interval in the order of 7 to 10 seconds. The lamp contains a gas fill of approximately 33% Argon and 67% oxygen, and a comparatively long strip of magnesium foil is supported longitudinally within the lamp bulb. The magnesium strip in Cressman is provided with an array of combustion regulating tabs which are claimed to keep the foil from curling while burning.

In contrast to Cressman, the lamp defined by the above-mentioned Fink and Fink et al patents employs a different fill gas composition and a much smaller and more compact foil configuration. The Fink patent uses a W-shaped corrugated configuration to space the foil away from the sides of the metal supporting frame, as proximity of the frame to the magnesium strip dampens the burning rate. In contrast, Cressman defines a planar strip. The arrangement of combustion-regulating tabs employed on this planar strip of Cressman has not been found suitable for the W-shaped foil configuration and gas fill composition of the lamp described in the Fink patent.

SUMMARY OF THE INVENTION

In view of the foregoing, it is an object of this invention to provide a long-duration photoflash lamp having an increased amount of useful light.

It is a particular object of the invention to increase the usable light of a long-duration type photoflash lamp by flattening the peak time of the light output curve so as to provide a more even supply of useful light, as well as increased intensity for a longer period of time.

Yet another object is to provide the above-mentioned objects at minimal cost.

These and other objects, advantages, and features are attained in accordance with the invention by providing a knurled surface on the strip of foil employed in the photoflash lamp. The knurling on the combustible foil surface supplies more area for ignition and has been observed to increase the useful light, i.e. the average lumen level, by nearly 7% without appreciably affecting the duration of lamp output. Further, the knurled foil provides a peak light curve which is leveled off, thereby providing a more uniform distribution of light. If the knurling is extended over the entire surface area of the foil, it has been observed to improve the adhesion of the edge primer coating to the foil as a result of the added surface area provided by the knurling. The knurling can be provided by running the combustible strip through a pair of knurling rollers or by the use of flat dies, thereby providing the above advantages at very little cost.

BRIEF DESCRIPTION OF THE DRAWINGS

This invention will be more fully described hereinafter in conjunction with the accompanying drawings in which.

DESCRIPTION OF PREFERRED EMBODIMENT

Figure 1:
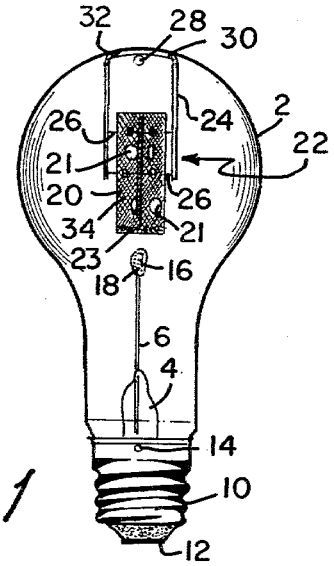
FIG. 1 is an elevational view of a photoflash lamp according to the invention.

Referring to FIGS. 1–5, the photoflash lamp comprises an hermetically sealed transparent envelope 2 of glass or the like within which a stem 4 is disposed. A pair of lead-in wires 6 are supported by and extend through the stem 4, the outer ends thereof being connected to the base 10 at 12 and 14 respectively, to provide the means through which electrical energy may be supplied to the lamp filament 16 which is attached to and supported by the lead-in wires at the inner ends thereof. The inner end of each of the lead-in wires 6 is provided with a glob of ignition paste 18 which usually contains an oxidizer, zirconium metal powder, and nitrocellulose binder.

A strip of corrugated magnesium foil 20, preferably provided with a plurality of apertures 21 therein to aid in combustion, is supported within the envelope 2 by a framework 22. Typically, the apertures 21 are circular and about 3/16 inch in diameter. To facilitate ignition of the strip of foil 20, the lower end thereof is preferably provided with a coating 23 of primer material comprising a mixture of zirconium metal powder and nitrocellulose binder. The framework 22 comprises a substantially U-shaped nickel wire 24 and a pair of spaced, substantially parallel molybdenum wires 26 attached to the wire 24 substantially transversely thereof. A length of nickel wire 28 or alloy #4 is attached to the bight 30 of the wire 24 substantially transversely thereof. The inner wall of the top of the envelope 2 is provided with a body of suitable cement mixture 32 within which the "cross" formed by wire 28 and bight 30, is embedded, thereby providing the means for supporting the framework 22. The transverse supporting wires 26 are threaded through holes 27 (e.g. about 1/16 inch diameter) in the corrugated foil 20 and are shaped to conform substantially to the contour of the corrugations of the foil. In this manner, the wires 26 maintain their shape and do not burn up during flashing of the lamp. It has also been found that the W-shaped corrugated foil 20 maintains its shape until consumed. These features permit flashing of the lamp in any position.

The combustion-supporting gas within the hermetically sealed, light-transmitting envelope 2 is preferably the mixture described in U.S. Pat. No. 2,955,447, i.e. oxygen and between about 2% and 12% nitrogen by volume. The gas pressure is preferably at about atmospheric or slightly below.

In accordance with the present invention, the strip of combustible foil 20 is provided with a knurled surface 34, for example, by running the magnesium strip through a pair of knurling rollers or by compressing the strip between a pair of flat knurled dies. As a result, an embossed effect is produced in the foil, as best shown by the upper portion of the fragmentary view in FIG. 4 and the edge view of FIG. 5. In a specific embodiment, a strip of magnesium having an initial thickness of 0.006 inch (prior to knurling) and planar dimensions of $1\frac{1}{2}$ inch$\times 1\frac{1}{2}$ inch, prior to being corrugated into a W-shaped configuration, was compressed between flat knurling dies to provide the pattern 34 of a medium, 21-pitch, diamond-faced knurl. The resulting embossing is not very deep, as the total cross-section dimensions, as measured across the knurled profile (FIG. 5) increased to about 0.010 inch. Viewed from a magnifying glass from the side edge (FIG. 5), a wavy configuration is observed. After knurling, the magnesium is fed into a punch press where the 1/16 inch mounting holes 27 and 3/16 inch apertures 21 are punched. The foil is then cut to size and bent into the W-shaped configuration.

Upon mounting this corrugated strip of knurled foil in the flashlamp of FIG. 1 and then igniting the lamp, it was observed, quite unexpectedly, that a significant increase in the usable light output was obtained without appreciably affecting the duration of the lamp output. Another surprising feature that was observed, while monitoring the light output of the knurled magnesium foil during combustion, was a leveling off of the peak light curve, resulting in a more uniform distribution of light. These improvements in the light output characteristics of the flashlamp are believed to be due to the fact that the knurling of the foil surface provides additional surface area for ignition. Further it is believed that the miniature concavities, or deeper areas, of the knurled surface pattern are less likely to be coated wih magnesium oxide when the foil is burning.

Figure 4:
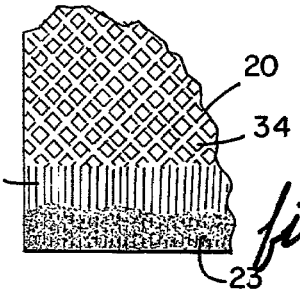
FIG. 4 is a greatly enlarged fragmentary detail of the knurled pattern on the foil, as well as the prior straight embossments on the edge.
Figure 2:
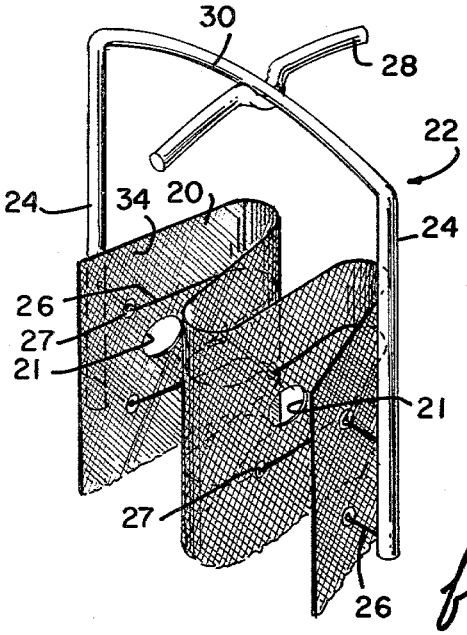
FIG. 2 is a fragmentary detail on an enlarged scale of the strip of knurled foil and its supporting structure.
Figure 5:
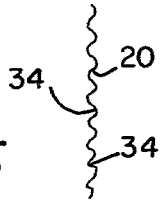
FIG. 5 is a greatly enlarged fragmentary edge view of the knurled foil.
Figure 3:
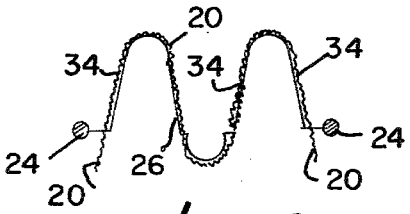
FIG. 3 is a top view of the strip of foil showing its knurled surface and corrugated configuration and the disposition of the cross supports associated therewith.

If the knurling is arranged in a regular pattern throughout the surface area of the foil, another advantage results in that the added surface area produced by the knurling will cause the primer mixture 23 to adhere better to the magnesium. A previously used method of accomplishing this same result was to employ a row of straight embossments 36 in the foil 20 along the edge of the strip adjacent the ignition means 16, etc., and disposing the primer coating 23 on the portion of the strip surface having these straight embossments 36, as illustrated at the bottom portion of FIG. 4. The use of this row of straight embossments, in itself, is not a part of the present invention; however, the surface knurling 34 of the present invention may be combined with the straight embossment pattern 36 as shown in FIG. 4.

Figure 6:
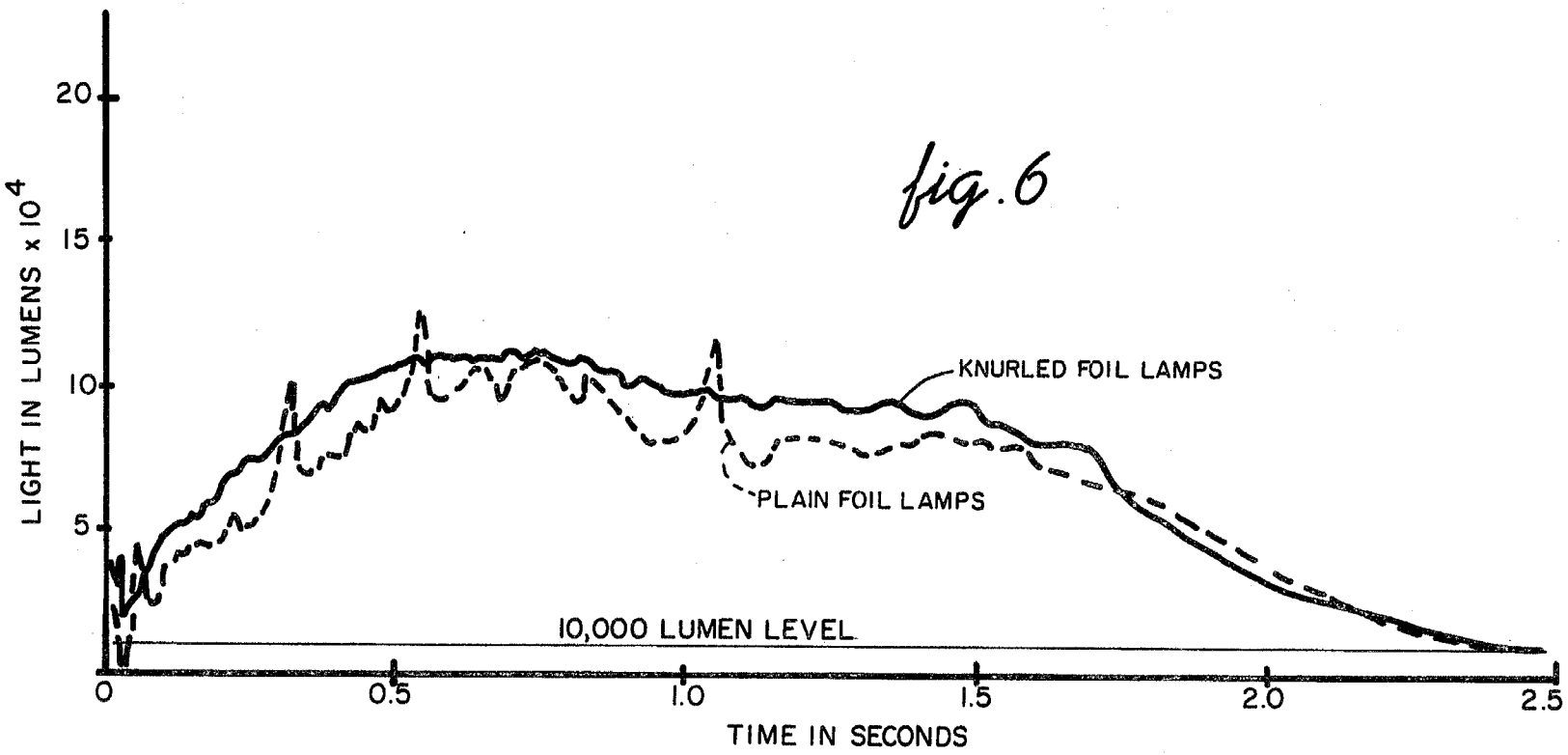
FIG. 6 shows typical light output vs time characteristic curves of plain foil lamps and knurled foil lamps.

Tests were made with two groups of photoflash lamps of the type described, one group employing a combustible strip of knurled foil according to the specific embodiment described above, and the other group of lamps employing plain magnesium foil. The foil weight ranged from 318 to 398 milligrams. The bulb volume was about 233 milliters, and the fill pressure of the above-described oxygen-nitrogen gas mixture was about 60 cm.Hg. The lamps employing knurled foil provided a light output having an average duration of about 2.39 seconds, an average total output of 145,670 lumen-seconds, and an average light level of 61,162 lumens. A similar lamp containing plain foil, on the other hand, provided a light output having an average duration of 2.54 seconds, an average total light output of 144,510 lumen-seconds, and an average light level of 57,318 lumens. Accordingly, referring to the average light level figures, the above test exhibits a gain of 6.7% in usable light for lamps employing the knurled foil in accordance with the invention. A slightly faster peak time and faster decay time, in addition to a leveling off of the curve therebetween, accounts for this result, as illustrated by the light characteristic curve of FIG. 6.

A more controlled test was also performed in which the magnesium strips were grouped into one weight category and used for all groups in the test. The weight of each magnesium strip employed in the tested lamps of all groups was about 396 milligrams, and the gas pressure was 60 cm.Hg. The first group tested comprised ten lamps of the type shown in FIG. 1, containing a knurled strip of magnesium with the holes 21. Upon flashing these ten lamps of the first group, the photometric results exhibited an average flash duration of 2.51 seconds, a total light output of 172,470 lumen-seconds, and an average light level of 68,870 lumens. A second group of lamps tested comprised nine lamps of the same construction except that a plain strip of magnesium with holes 21 was employed. The photometric results for the second group of lamps exhibited an average flash duration of 2.68 seconds, a total light output of 176,890 lumen-seconds, and an average light level of 66,576 lumens. Hence, in this test, the lamps with knurled magnesium with holes resulted in 3.3% more usable light and a more even light curve. Lamps employing magnesium strips without the holes 21 exhibited a longer duration and lower average light level than like strips of magnesium of the same weight.

Although the invention has been described with respect to specific embodiments, it will be appreciated that modifications and changes may be made by those skilled in the art without departing from the true spirit and scope of the invention.

What I claim is:

1. A photoflash lamp comprising:

a hermetically sealed, light-transmitting envelope;

a combustion-supporting gas filling in said envelope;

a corrugated strip of combustible foil disposed in said envelope, said foil having a knurled surface;

support means for said corrugated strip of knurled foil; and ignition means disposed in said envelope in operative relationship with respect to said knurled foil.

2. A lamp according to claim 1 wherein the knurling on said strip of foil is arranged in a regular pattern throughout the surface area thereof.

3. A lamp according to claim 2 wherein said corrugated strip of knurled foil is supported in a longitudinal position within said envelope, and further including a coating, comprising a mixture of zirconium metal powder and a binder, on a portion of said strip adjacent to said ignition means whereby firing of said strip by said ignition means is facilitated.

4. A lamp according to claim 1 wherein the knurling on said strip of foil comprises an arrangement of diamond-faced knurls arranged in a regular pattern throughout a substantial portion of the surface area of said foil, and further including a row of straight embossments in said foil along the edge of said strip adjacent to said ignition means, and a coating, comprising a mixture of zirconium metal powder and a binder, on the portion of said strip having said straight embossments, whereby firing of said strip by said ignition means is facilitated.

5. A lamp according to claim 4 wherein said support means comprises a supporting framework for said foil secured to an inner wall of said envelope and depending therefrom, said framework including support wires threaded through apertures provided therefor in said foil, said support wires being shaped to conform to the contour of said corrugations and being substantially in contact therewith along the major portion of their length.

6. A lamp according to claim 1 wherein the material of said foil is magnesium.

7. A lamp according to claim 6 wherein said corrugated strip of knurled magnesium foil is provided with a plurality of apertures.

8. A lamp according to claim 6 wherein said gas filling consists essentially of oxygen and between about 2% to about 12% of nitrogen by volume.

9. A lamp according to claim 6 wherein said corrugated strip of foil is formed from a strip of magnesium foil having a thickness of 0.006 inch prior to knurling, a cross-section dimension of 0.010 inch as measured across the knurled profile, and planar dimensions of $1\frac{1}{2}$ inch$\times 1\frac{1}{2}$ inch prior to being corrugated into a W-shaped configuration.

10. A lamp according to claim 1 wherein the knurling on the surface of said foil is provided in the pattern of a medium, 21-pitch, diamond-faced knurl.

* * * * *